US012611085B1

(12) United States Patent
O'Callaghan et al.

(10) Patent No.: US 12,611,085 B1
(45) Date of Patent: Apr. 28, 2026

(54) DRYING PAD

(71) Applicant: Dorai Home, Inc., West Valley City, UT (US)

(72) Inventors: Kelsey O'Callaghan, Salt Lake City, UT (US); Jason Klug, Salt Lake City, UT (US)

(73) Assignee: Dorai Home, Inc., West Valley City, UT (US)

( * ) Notice: Subject to any disclaimer, the term of this patent is extended or adjusted under 35 U.S.C. 154(b) by 0 days.

(21) Appl. No.: 19/362,327

(22) Filed: Oct. 17, 2025

Related U.S. Application Data

(60) Provisional application No. 63/708,521, filed on Oct. 17, 2024.

(51) Int. Cl.
*A47L 19/02* (2006.01)

(52) U.S. Cl.
CPC ..... *A47L 19/02* (2013.01)

(58) Field of Classification Search
CPC ..... A47L 19/02
USPC ..... 34/95
See application file for complete search history.

(56) References Cited

U.S. PATENT DOCUMENTS 5,555,640 A * 9/1996 Ou ..... F26B 25/066 312/249.9
5,572,802 A * 11/1996 Alpenfels ..... F26B 9/04 34/237
RE43,349 E * 5/2012 Dunn ..... A47L 19/04 211/41.6
RE43,635 E * 9/2012 Dunn ..... A47L 19/04 211/41.6
9,052,143 B2 * 6/2015 Janowski ..... F26B 21/12
9,763,556 B2 * 9/2017 Kåberg ..... A47L 15/502
10,149,596 B2 * 12/2018 Hederstierna ..... A47L 15/502
10,988,896 B2 * 4/2021 Tsui ..... B65D 41/04
11,039,731 B2 * 6/2021 Han ..... A47L 19/04
11,802,366 B2 * 10/2023 Bickerton ..... A47L 23/20
11,832,777 B2 * 12/2023 Klug ..... A47L 19/02
12,405,059 B2 * 9/2025 Davis ..... F26B 21/083
(Continued)

FOREIGN PATENT DOCUMENTS

CN 104219986 A * 12/2014 ..... A47L 19/04
CN 114652100 A * 6/2022 ..... A47L 23/205
EP 4018906 A1 * 6/2022 ..... A47L 23/205
(Continued)

*Primary Examiner* — Stephen M Gravini
(74) *Attorney, Agent, or Firm* — Headland Law & Strategy; Matthew J. Smyth

(57) ABSTRACT

A drying pad may include a slab comprising diatomaceous earth and an elastomeric support frame. The slab may be characterized by a thickness, an outer perimeter, a top surface and a bottom surface; the slab further include at least one groove that extends into the top surface. The elastomeric support frame may have a top edge, a bottom edge, a side band coupling the top edge and the bottom edge, and a plurality of feet extending from the bottom edge. The side band may cover the outer perimeter; and the top edge, the bottom edge and the side band may enclose an outer portion of the slab adjacent the outer perimeter. The plurality of feet may extend away from the bottom edge such that when the plurality of feet are disposed on a horizontal surface, a gap exists between the bottom surface and the horizontal surface.

7 Claims, 4 Drawing Sheets

(56) References Cited

U.S. PATENT DOCUMENTS 12,467,688 B2 * 11/2025 Kessell ..... A61B 50/22

FOREIGN PATENT DOCUMENTS

KR 20100041032 A * 4/2010 ..... D06F 58/04
WO WO-2013150510 A1 * 10/2013 ..... F26B 21/12

* cited by examiner

DRYING PAD

CROSS REFERENCE TO RELATED APPLICATIONS

This application claims priority to U.S. Application Ser. No. 63/708,521, titled "Drying Pad," filed on Oct. 17, 2024. This application incorporates the entire contents of the foregoing application herein by reference.

TECHNICAL FIELD

Various implementations relate generally to drying pads, such as, for example, diatomaceous earth-based drying pads that may be employed in kitchen applications.

BACKGROUND

A drying pad or rack may be used adjacent to a kitchen sink for the collection of wet or partially dried dishes subsequent to the manual washing of the dishes in the sink. Dishes may be rinsed and placed on the pad or rack to air-dry.

SUMMARY

In some implementations, a drying pad may include a slab comprising diatomaceous earth and an elastomeric support frame. The slab may be characterized by a thickness, an outer perimeter, a top surface and a bottom surface; the slab may further include at least one groove that extends into the top surface. The elastomeric support frame may have a top edge, a bottom edge, a side band coupling the top edge and the bottom edge, and a plurality of feet extending from the bottom edge. The side band may cover the outer perimeter; and the top edge, the bottom edge and the side band may enclose an outer portion of the slab adjacent the outer perimeter. The plurality of feet may extend away from the bottom edge such that when the plurality of feet are disposed on a horizontal surface, a gap exists between the bottom surface and the horizontal surface.

In some implementations, the slab may be generally rectangular and may be further characterized by a slab length and a slab width. The at least one groove may be parallel to at least one of the slab length or the slab width. The elastomeric support frame may be generally rectangular, may correspond in shape and size to the generally rectangular slab and may be characterized by a frame width and a frame length. The plurality of feet may include feet in each corner of the generally rectangular elastomeric support frame and intermediate feet between the corner feet along at least one of the frame width or the frame length. In some implementations, the slab and elastomeric support frame may be configured in form as at least one of a circle, a triangle, a multi-sided polygon or an irregular shape.

DETAILED DESCRIPTION

Figure 1A:
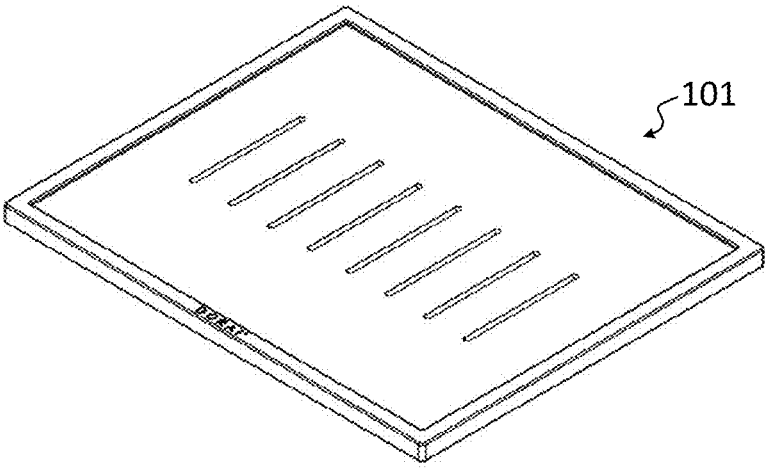
FIG. 1A illustrates an exemplary drying pad.
Figure 1B:
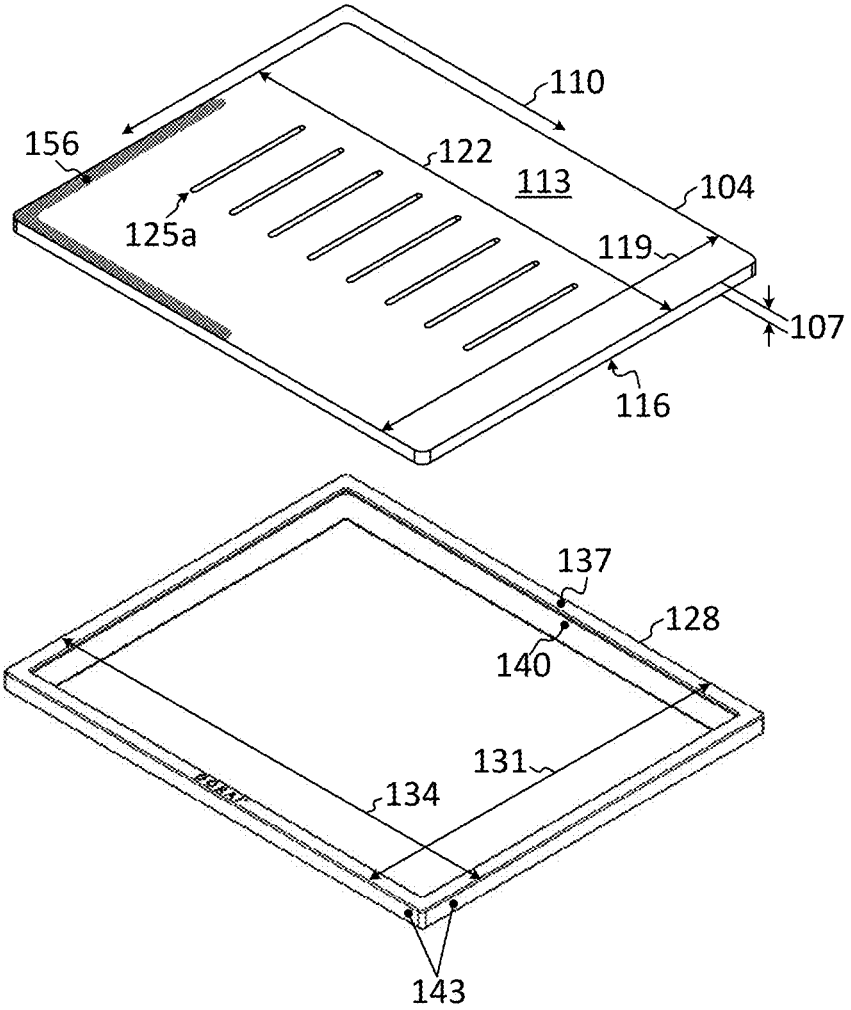
FIG. 1B is an exploded view of the exemplary drying pad of FIG. 1A.

FIG. 1A illustrates an exemplary drying pad 101, and FIG. 1B is an exploded view of the same. As shown in FIGS. 1A and 1B, the exemplary drying pad 101 includes a generally rectangular slab 104. In some implementations, slab 104 comprises diatomaceous earth. In other implementations, the slab 104 comprises another absorbent material that wicks liquid into its volume, disperses that liquid throughout its volume, and facilitates evaporation of the same from across its external surface. The slab 104 may be characterized by a thickness 107, an outer perimeter 110, a top surface 113, a bottom surface 116, a slab width 119 and a slab length 122.

In some implementations, the slab 104 includes at least one groove (e.g., groove 125*a*; collectively, grooves 125) that extends into the top surface 113. In some implementations, as shown, the groove 125*a* may be parallel to the slab width 119; in other implementations the groove 125*a* may be parallel to the slab length 122; in still other implementations, the groove 125*a* may be disposed at some angle relative to either the slab width 119 or the slab length 122.

As shown, the exemplary drying element 101 further includes a generally rectangular support frame 128. In some implementations, the support frame 128 comprises an elastomeric material, such as, for example, silicone, food-grade silicone or another elastic and resilient polymer, rubber or other material.

The support frame 128 may be characterized by a frame width 131 and a frame length 134 that correspond, respectively, to the slab width 119 and slab length 122. (As used herein, "correspond to" may mean "having approximately the same shape and size as"; and as used herein, "about," "approximately" or "substantially" may mean within 1%, or 5%, or 10%, or 20%, or 50%, or 100% of a nominal value.). The support frame 128 may further include a top edge 137, a bottom edge 140, a side band 143 coupling the top edge 137 and the bottom edge 140. In some implementations, the support frame 128 is configured to be stretched around and enclose an outer portion 156 of the slab 104.

Figure 1C:
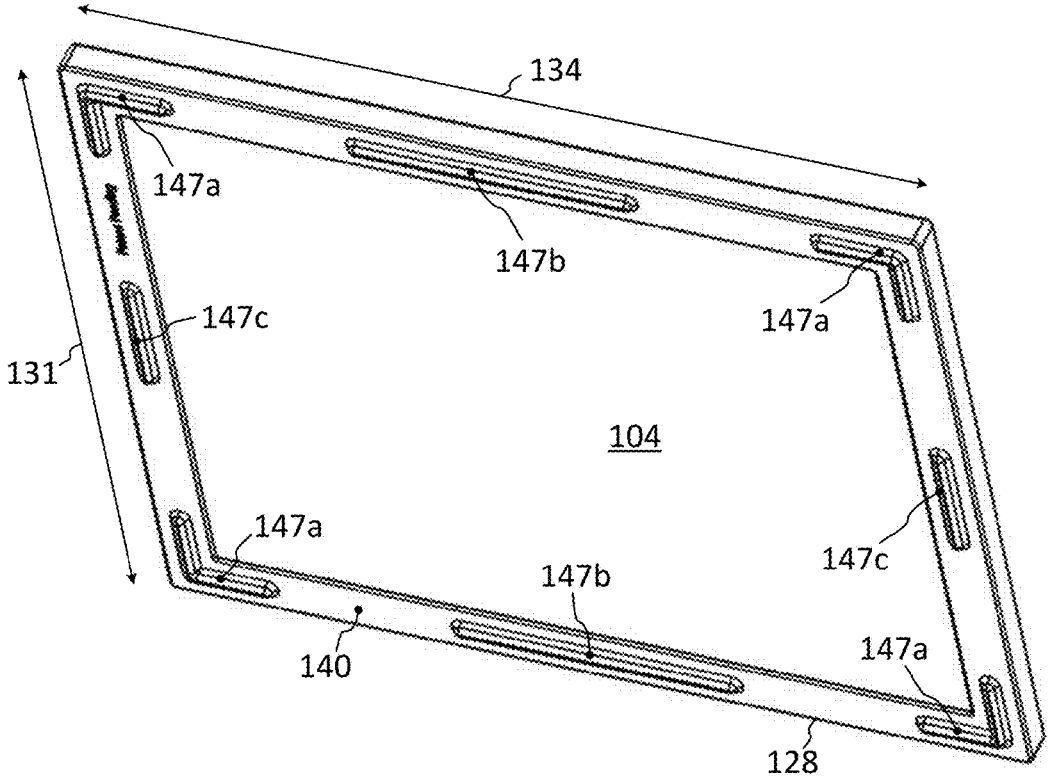
FIG. 1C is a back perspective view of the exemplary drying pad of FIG. 1A.

Turning to FIG. 1C, which is a back perspective view of the exemplary drying pad 101, the support frame 128 may also include a plurality of feet 147 that extend away from the bottom edge 140. In some implementations, the plurality of feet 147 include corner feet 147*a* at each corner of the support frame 128; in some implementations, the plurality of feet 147 include intermediate feet 147*b* between corner feet 147 and along a frame length 134; in some implementations, the plurality of feet 147 include intermediate feet 147*c* along a frame width 131; in some implementations, the plurality of feet 147 include all of the foregoing feet 147*a*, 147*b* and 147*c*; and in other implementations, the plurality of feet 147 include only a subset of the foregoing.

Figure 1D:
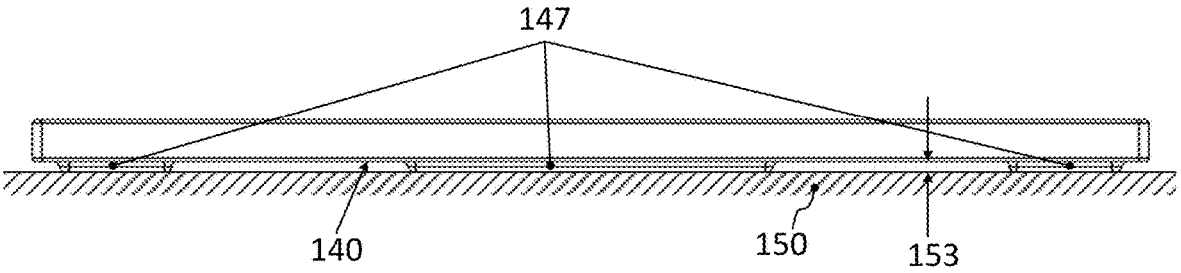
FIG. 1D is a side view of the exemplary drying pad of FIG. 1A.

In some implementations, as depicted in FIG. 1D, the plurality of feet 147 extend away from the bottom edge 140 such that when they are disposed on a horizontal surface 150, a gap 153 exists between the bottom edge 140 and the horizontal surface 150. This gap 153 may facilitate airflow under and around the drying element 101 (specifically, the slab 104), such that evaporation of any liquid contained in the slab 104 may be accelerated.

As shown in FIGS. 1A-1C, the side band 143 may cover the outer perimeter 110 of the slab 104, and the top edge 137, side band 143 and bottom edge 140 may enclose the outer portion 156 of the slab 104 adjacent the outer perimeter 110.

Figure 2:
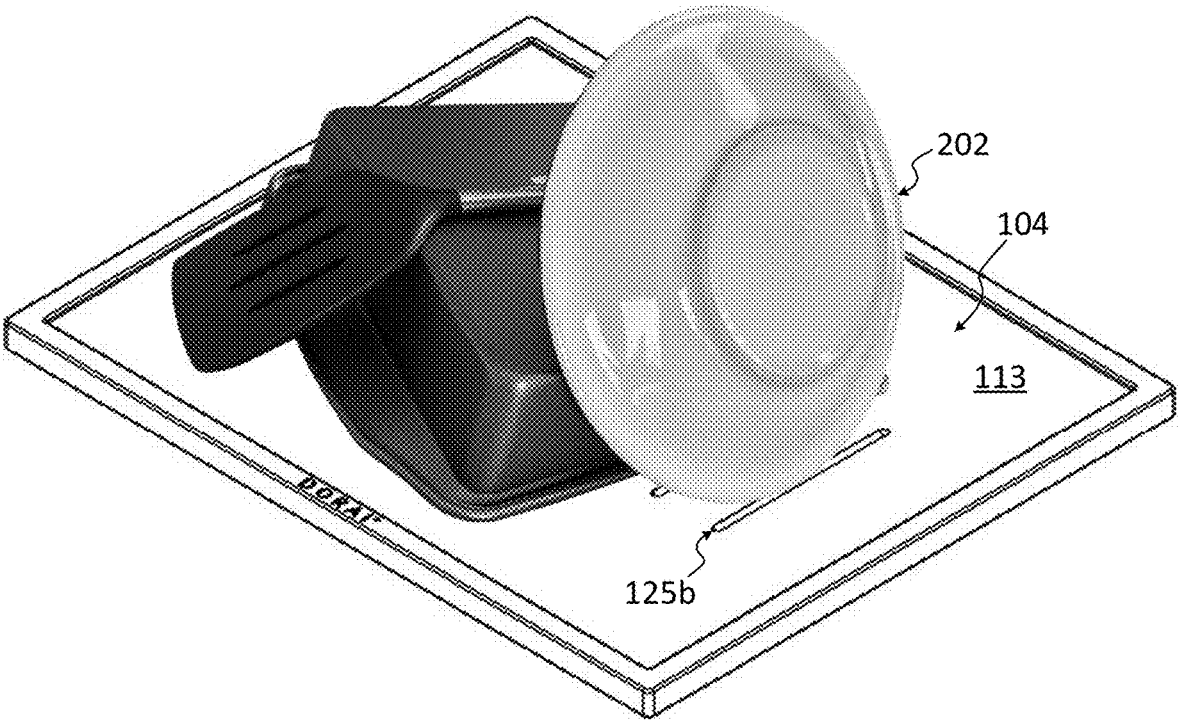
FIG. 2 depicts an exemplary use of a drying pad.

Turning to FIG. 2, one or more grooves (e.g., groove 125*b*; collectively, grooves 125) may serve multiple purposes. For example, the grooves 125 may increase the surface area of the top surface 113 of the slab 104, such that absorption of liquid (e.g., from wet dishes that are disposed on the drying element 101, as depicted in FIG. 2) is enhanced. As another example, the groove 125*b* may help support dishes (e.g., plate 202) in an upright or inclined position to facilitate draining of liquid on the dishes into the slab 104. To facilitate this latter exemplary function, the grooves 125 may extend sufficiently into the top surface 113 and be wide enough to "grab" the edges of dishes that may be partially disposed within the grooves 125. For example, in some implementations, the grooves 125 may be at least about 4-5 mm wide and at least about 3-6 mm wide. These exemplary measurements are only that—in other implementations, width may be at least about 2 mm and up to about 12-13 mm, and depth may be between about 3 mm and about one half the thickness of the slab 104; in still other implementations, width and depth may have other absolute or relative dimensions.

Figure 3A:
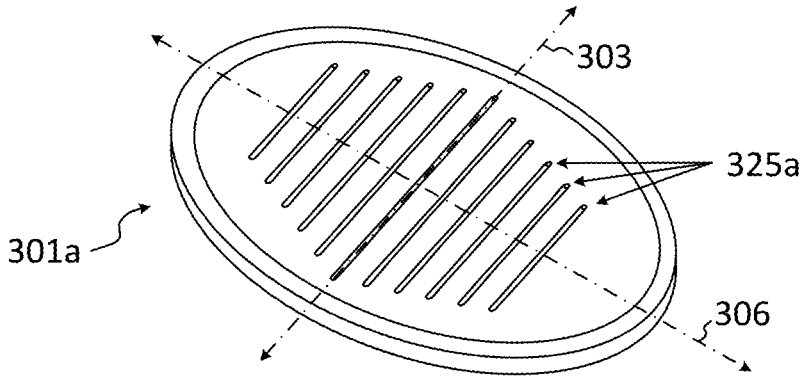
FIGS. 3A-3C illustrate exemplary alternative shapes to drying pads.

In some implementations, the slab and frame described above may have a shape other than a rectangle. For example, with reference to FIG. 3A, a drying pad 301*a* may have a circular or elliptical shape. Grooves 325*a* may be parallel to a first axis 303 and/or perpendicular to a second axis 306. Moreover, as depicted, multiple grooves 325 may vary in length—in some cases, roughly following an outer edge of the drying pad 301*a*, as shown.

Figure 3B:
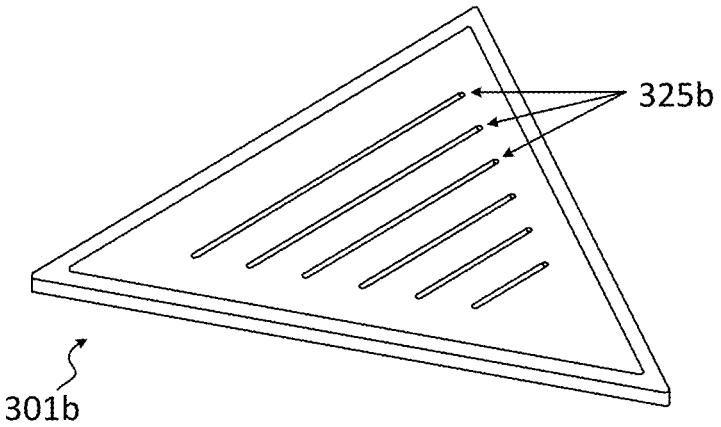

As another example, as depicted in FIG. 3B, a drying pad 301*b* may have a polygonal shape. A triangle shape is shown, but polygons with other numbers of sides (four, five, six, seven, eight, ten, etc.) may be employed. Moreover, such polygons may be regular or irregular. Grooves 325*b* may vary in length and may be disposed parallel to an edge of the drying pad 301*b*, as shown, or they may be disposed in a different manner.

Figure 3C:
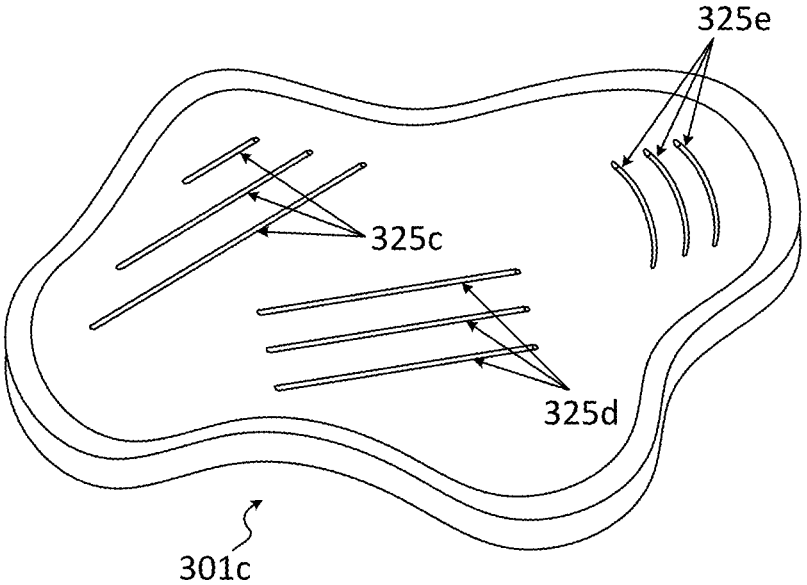

As another example, as depicted in FIG. 3C, a drying pad 301*c* may have an irregular or amorphous shape. Grooves 325*c*, 325*d* or 325*e* may have varied lengths or fixed lengths; and such grooves 325*c*, 325*d* or 325*e* may have various angular relationships to each other and to any nearby edge of the drying pad 301*c*.

Several implementations have been described with reference to exemplary aspects, but it will be understood by those skilled in the art that various changes may be made and equivalents may be substituted for elements thereof without departing from the contemplated scope. For example, various materials may be used for both the slab and the support frame; various numbers and shapes of legs may be employed to separate the drying pad (particularly the slab) from a horizontal surface on which it is disposed; drying pads may have various shapes and sizes; various numbers of grooves may be included (from at least one, to many); grooves may have various widths and depths; grooves may be linear or non-linear.

Many other variations are possible, and modifications may be made to adapt a particular situation or material to the teachings provided herein without departing from the essential scope thereof. Therefore, it is intended that the scope include all aspects falling within the scope of the appended claims.

What is claimed is:

1. A drying pad, comprising:

a generally rectangular slab comprising diatomaceous earth and being characterized by a thickness, an outer perimeter, a top surface, a bottom surface, a slab width and a slab length; the slab further comprising at least one groove that extends into the top surface and that is parallel to at least one of the length or the width; and a generally rectangular elastomeric support frame being characterized by a frame width and a frame length that correspond, respectively, to the slab width and slab length, and having a top edge, a bottom edge, a side band coupling the top edge and the bottom edge, and a plurality of feet extending away from the bottom edge such that when the plurality of feet are disposed on a horizontal surface, a gap exists between the bottom surface and the horizontal surface;

wherein the side band covers the outer perimeter; and the top edge, the bottom edge and the side band enclose an outer portion of the slab adjacent the outer perimeter; and wherein the plurality of feet comprises corner feet at each corner of the generally rectangular elastomeric support frame and intermediate feet between the corner feet along at least one of the frame width or the frame length.

2. A drying pad, comprising:

a slab comprising diatomaceous earth and being characterized by a thickness, an outer perimeter, a top surface and a bottom surface; the slab further comprising at least one groove that extends into the top surface; and an elastomeric support frame having a top edge, a bottom edge, a side band coupling the top edge and the bottom edge, and a plurality of feet extending from the bottom edge;

wherein the side band covers the outer perimeter; and the top edge, the bottom edge and the side band enclose an outer portion of the slab adjacent the outer perimeter; and wherein the plurality of feet each extend away from the bottom edge such that when the plurality of feet are disposed on a horizontal surface, a gap exists between the bottom surface and the horizontal surface.

3. The drying pad of claim 2, wherein the slab is generally rectangular and is further characterized by a slab length and a slab width.

4. The drying pad of claim 3, wherein the at least one groove is parallel to at least one of the slab length or the slab width.

5. The drying pad of claim 3, wherein the elastomeric support frame is generally rectangular, corresponds in shape and size to the generally rectangular slab and is characterized by a frame width and a frame length.

6. The drying pad of claim 5, wherein the plurality of feet comprise feet in each corner of the generally rectangular elastomeric support frame and intermediate feet between the corner feet along at least one of the frame width or the frame length.

7. The drying pad of claim 2, wherein the slab and elastomeric support frame are configured in form as at least one of a circle, a triangle, a multi-sided polygon or an irregular shape.

* * * * *